US008712294B2

(12) United States Patent
Koyama et al.

(10) Patent No.: US 8,712,294 B2
(45) Date of Patent: Apr. 29, 2014

(54) IMAGE FORMING UNIT HAVING AGITATING PORTION AND IMAGE FORMING APPARATUS

(75) Inventors: Tetsu Koyama, Tokyo (JP); Takuya Goto, Tokyo (JP)

(73) Assignee: Oki Data Corporation, Tokyo (JP)

( * ) Notice: Subject to any disclaimer, the term of this patent is extended or adjusted under 35 U.S.C. 154(b) by 290 days.

(21) Appl. No.: 13/273,315

(22) Filed: Oct. 14, 2011

(65) Prior Publication Data

US 2012/0093541 A1 Apr. 19, 2012

(30) Foreign Application Priority Data

Oct. 15, 2010 (JP) ..... 2010-232945

(51) Int. Cl.
*G03G 15/08* (2006.01)

(52) U.S. Cl.
USPC ..... 399/256; 366/278; 366/325.92; 399/254

(58) Field of Classification Search
USPC ..... 399/254, 256, 258, 262, 273, 283; 366/276–278, 309, 325.92, 325.93, 366/312
See application file for complete search history.

(56) References Cited

U.S. PATENT DOCUMENTS 4,956,674 A * 9/1990 Kalyandurg
2005/0123324 A1 6/2005 Kawano et al.

FOREIGN PATENT DOCUMENTS

EP 1538489 A1 6/2005
JP 2005-172842 A 6/2005

* cited by examiner

*Primary Examiner* — Susan Lee
(74) *Attorney, Agent, or Firm* — Panitch Schwarze Belisario & Nadel LLP

(57) ABSTRACT

A image forming unit includes an image forming unit including an image bearing body that bears a latent image, a developer bearing body that develops the latent image, a developer supplying portion that supplies the developer to the developer bearing body, an agitating portion provided in the vicinity of the developer supplying portion and including a plate member for agitating the developer in the vicinity of the developer supplying portion and a rotation shaft that holds the plate member, and a driving mechanism that causes the plate member of the agitating portion to reciprocatingly swing about the rotation shaft.

10 Claims, 9 Drawing Sheets

IMAGE FORMING UNIT HAVING AGITATING PORTION AND IMAGE FORMING APPARATUS

BACKGROUND OF THE INVENTION

The present invention relates to an image forming unit detachably mounted to a main body, and relates to an image forming apparatus having the image forming unit.

An image forming unit of an image forming apparatus includes a photosensitive drum that bears a latent image, and a developing roller that contacts the photosensitive drum for developing the latent image using a toner. The image forming unit further includes a supplying roller that contacts the developing roller for supplying the toner (supplied by a toner tank) to the developing roller, and an agitating member that agitates the toner for preventing agglomeration of the toner. These members are rotated by a driving source provided in the image forming apparatus. The agitating member is provided in contact with or in the vicinity of the supplying roller, and rotates in one direction to supply the toner to the supplying roller (see, for example, Japanese Laid-open Patent Publication No. 2005-172842).

In this regard, a conventional image forming unit has an agitating member in the form of a crank and rotatable about a center thereof. With such a configuration, the agitating member has a relatively small rotation radius, and can agitate the toner only in a small area. Therefore, agglomeration of the toner may occur outside the small area. In such a case, the toner may not be sufficiently supplied to the supplying roller. As a result, the amount of the toner supplied by the supplying roller to the developing roller decreases, and image defects such as image blurring may occur, i.e., image quality may be deteriorated.

Further, it is conceivable to provide a plurality of agitating members for agitating the toner in a large area. However, such a configuration may be subjected to spatial limitation, and subjected to an increase in cost.

SUMMARY OF THE INVENTION

In an aspect of the present invention, it is intended to provide an image forming unit and an image forming apparatus having capable of preventing agglomeration of a developer with a simple configuration.

According to an aspect of the present invention, there is provided an image forming unit including an image bearing body that bears a latent image, a developer bearing body that develops the latent image, a developer supplying portion that supplies the developer to the developer bearing body, an agitating portion provided in the vicinity of the developer supplying portion and including a plate member for agitating the developer in the vicinity of the developer supplying portion and a rotation shaft that holds the plate member, and a driving mechanism that causes the plate member of the agitating portion to reciprocatingly swing about the rotation shaft.

Further scope of applicability of the present invention will become apparent from the detailed description given hereinafter. However, it should be understood that the detailed description and specific embodiments, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENT

Hereinafter, embodiments of the present invention will be described with reference to the attached drawings. Descriptions will be made of a color printer as an example of an image forming apparatus in which an image forming unit of the present invention is mounted.

First Embodiment

<Configuration>

Figure 1:
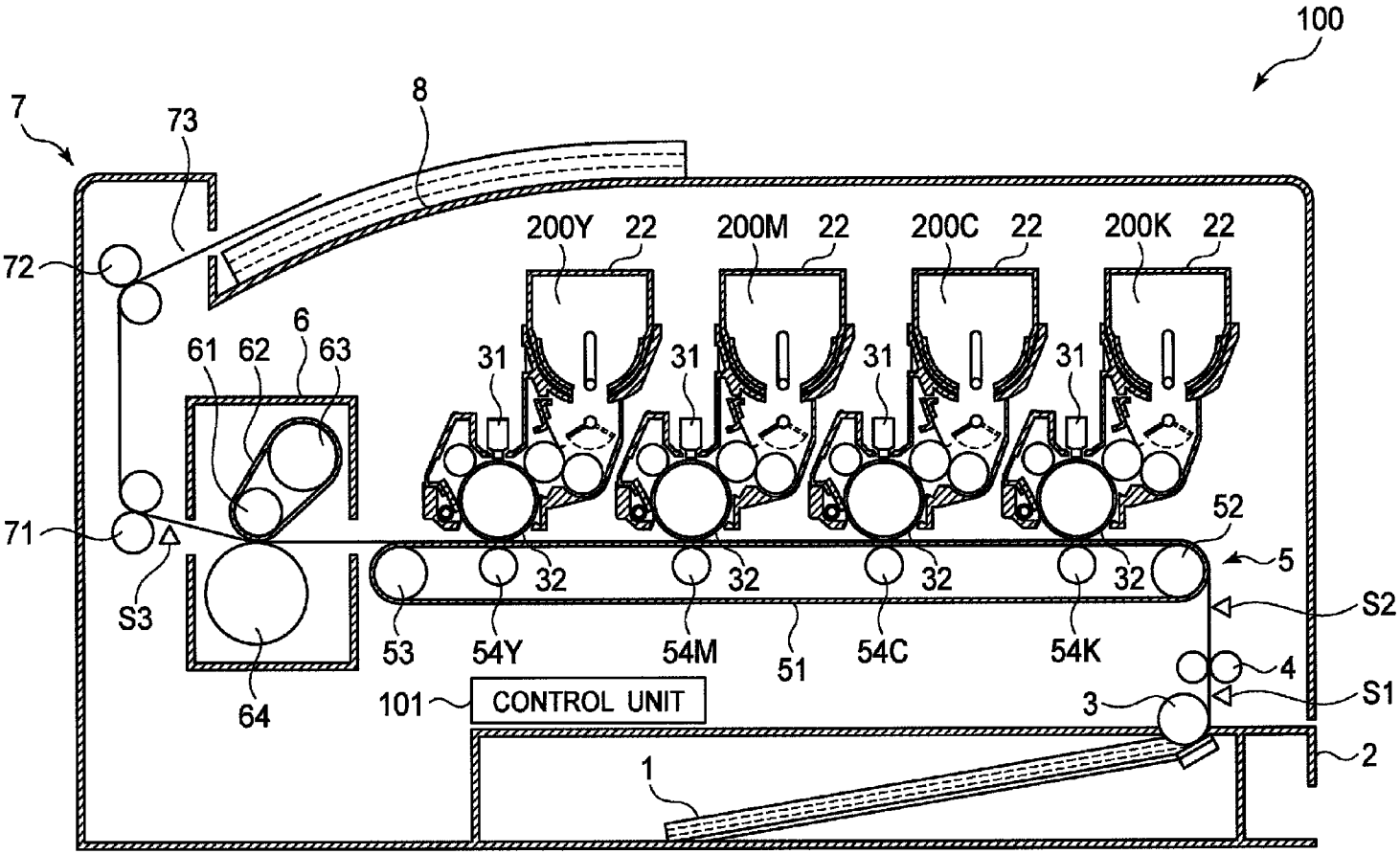
FIG. 1 is a schematic view showing a configuration of an image forming apparatus according to the first embodiment of the present invention.

FIG. 1 is a schematic view showing an image forming apparatus 100 according to the first embodiment of the present invention. A configuration of the image forming apparatus 100 will be described with reference to FIG. 1.

A medium cassette 2 is detachably mounted to a lower part of a main body of the image forming apparatus 100. A stack of printing media (such as printing sheets) is stored in the medium cassette 2. Although the image forming apparatus 100 of this embodiment has a single medium cassette 2 in this embodiment, it is also possible that the image forming apparatus 100 has a plurality of medium cassettes.

A feeding roller 3 is provided on a feeding side (i.e., right side in FIG. 1) of the medium cassette 2, for feeding the printing medium 1 from the medium cassette 2. The feeding roller 3 is disposed so as to contact the uppermost printing medium 1 placed on the medium cassette 2. The feeding roller 3 is driven to rotate under the control of a control unit 101, and feeds the printing medium 1 one by one from the medium cassette 2. The printing medium 1 fed by the feeding roller 3 reaches a conveying path.

A feeding sensor (not shown) is provided on a downstream side (i.e., right side in FIG. 1) of the feeding roller 3. The feeding sensor detects a leading edge of the printing medium 1, and outputs a detection signal to the control unit 101. Based on the detection signal, the control unit 101 detects that the printing medium 1 is fed by the feeding roller 3 from the medium cassette 2.

A pair of registration rollers 4 are provided adjacent to the feeding roller 3. The registration rollers 4 are driven under the control of the control unit 101, and convey the printing medium 1 to a transfer belt 51 described later.

An inlet sensor S1 is provided on an upstream side of the registration rollers 4. The inlet sensor S1 detects the leading edge of the printing medium 1, and outputs a detection signal to the control unit 101. Based on the detection signal, the control unit 101 determines a timing to start rotating the registration rollers 4.

A writing sensor S2 is provided on a downstream side of the registration rollers 4. The writing sensor S2 detects the leading edge of the printing medium 1 (conveyed from the registration rollers 4), and outputs a detection signal to the control unit 101. Based on the detection signal, the control unit 101 determines a timing to start exposing a surface of a photosensitive drum 32 of each of image forming units 200K, 200C, 200M and 200Y so as to align a starting position of latent image formation on the photosensitive drum 32 with a starting position of toner image formation on the printing medium 1.

The image forming units 200K, 200C, 200M and 200Y have the same configuration, and are also collectively referred to as the image forming units 200.

Figure 2:
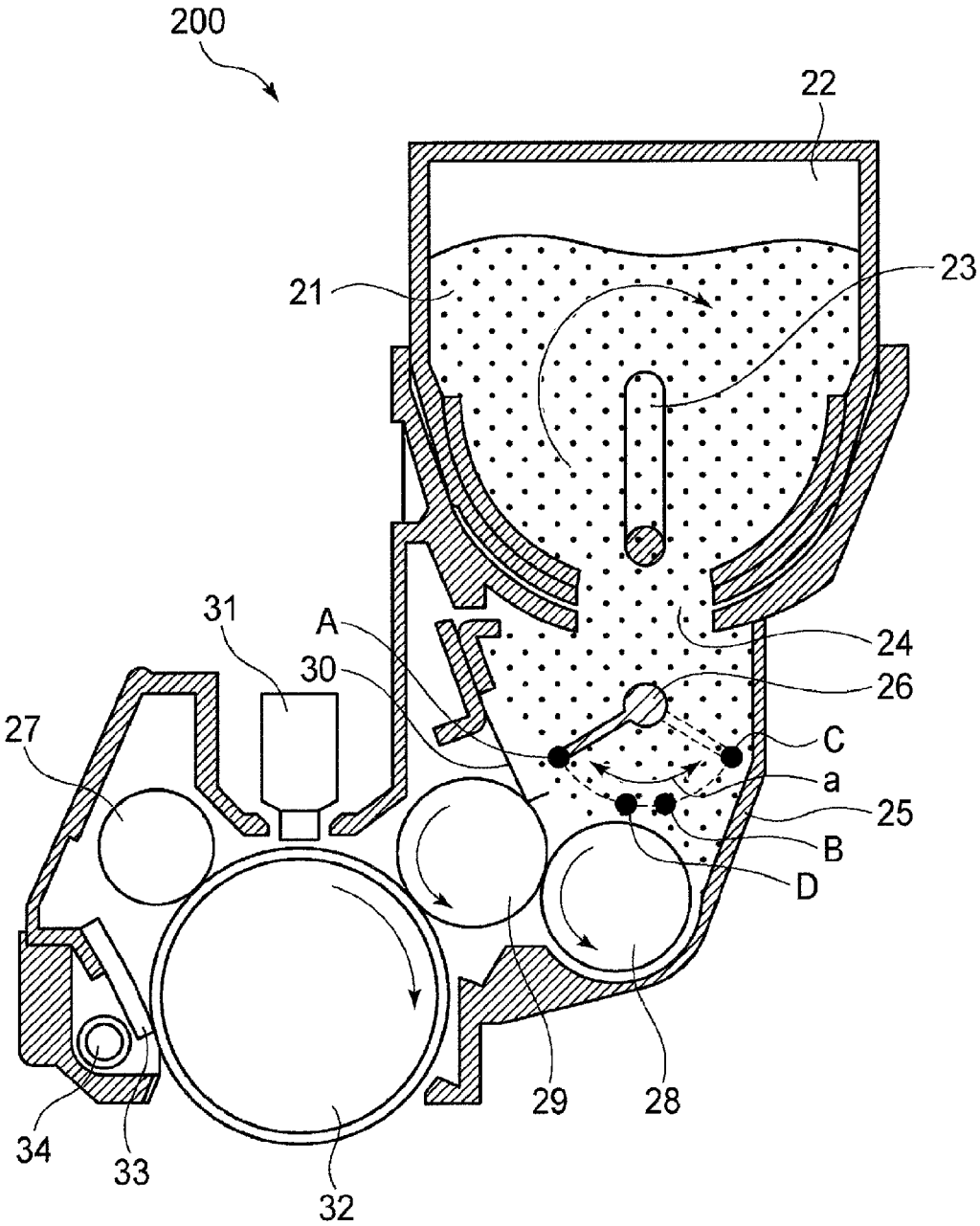
FIG. 2 is a sectional view of an image forming unit according to the first embodiment of the present invention.

FIG. 2 is a schematic view showing a configuration of the image forming unit 200. The image forming unit 200K is configured to form a black toner image, and includes a toner storage container 22 as a storage container for storing a black toner 21, a storage container agitating portion 23 for agitating the toner 21 in the toner storage container 22, a supplying opening 24, a toner hopper 25 as a developer storage region for temporarily storing the toner 21, and an agitating portion 26 for agitating the toner 21 stored in the toner hopper 25. The image forming unit 200K further includes a charging roller 27 as a charging member, a supplying roller 28 as a developer supplying portion, a developing roller 29 as a developer bearing body, a layer regulating blade 30 as a developer regulating member, an exposing device 31, a photosensitive drum 32 as an image bearing body, a cleaning blade 33, and a waste toner conveying member 34.

The image forming unit 200K is configured to form a toner image on the photosensitive drum 32 under the control of the control unit 101.

In the image forming unit 200C, a cyan toner 21 is stored in the toner storage container 22, and a cyan toner image is formed on the photosensitive drum 32. The image forming unit 200C has the same configuration as the image forming unit 200K in other respects.

In the image forming unit 200M, a magenta toner 21 is stored in the toner storage container 22, and a magenta toner image is formed on the photosensitive drum 32. The image forming unit 200M has the same configuration as the image forming unit 200K in other respects.

In the image forming unit 200Y, a yellow toner 21 is stored in the toner storage container 22, and a yellow toner image is formed on the photosensitive drum 32. The image forming unit 200Y is has the same configuration as the image forming unit 200K in other respects.

The charging roller 27 as a charging member is configured to uniformly charge the surface of the photosensitive drum 32. The charging roller 27 is applied with a predetermined charging voltage under the control of the control unit 101, and uniformly charges the surface of the photosensitive drum 32 when the photosensitive drum 32 rotates.

The exposure device 31 includes an array of LEDs (Light Emitting Diodes). The exposure device 31 emits light so as to expose the surface of the photosensitive drum 32 according to image data stored in an image memory under the control of the control unit 101.

When the photosensitive drum 32 rotates, the storage container agitating portion 23 in the toner storage container 32 rotates, and agitates the toner 21 stored in the toner storage container 22. The storage container agitating portion 23 has a rotation shaft provided with a gear that engages (via an idle gear) a drum gear fixed to a rotation shaft of the photosensitive drum 32.

Similarly, when the photosensitive drum 32 rotates, the agitating portion 26 provided in the toner hopper 25 swings in an arc about a rotation shaft from a point A to a point C, and then swings from the point C to the point A. In other words, the agitating portion 26 reciprocatingly swings in an arc as shown by an arrow "a" in FIG. 2. A configuration, of the agitating portion 26 and a configuration for reciprocating swinging the agitating portion 26 will be described later. When the agitating portion 26 repeatedly and reciprocatingly swings in an arc, and the toner 21 is supplied to the surface of the supplying roller 28 without causing agglomeration.

The toner 21 supplied to the supplying roller 28 adheres to the surface of the developing roller 29 that rotates under the control of the control unit 101. The toner 21 adhering to the surface of the developing roller 29 is formed into a thin toner layer having a uniform thickness by means of the layer regulating blade 30. The toner 21 adheres to the surface of the photosensitive drum 32 on which the latent image is formed, with the result that the toner image (as a developer image) of black is formed on the photosensitive drum 32.

In this regard, the developing roller 29 is also referred to as a developer bearing body that develops the latent image on the surface of the photosensitive drum 32 (as an image bearing body) using the toner as a developer. The supplying roller 28 is also referred to as a developer supplying portion (or a supplying member) that supplies the toner to the developing roller 29 (i.e., the developer bearing body).

Similarly, in the image forming units 200C, 200M and 200Y, toner images of cyan, magenta and yellow are formed on the photosensitive drums 32 corresponding to latent images.

As shown in FIG. 1, an image transfer portion 5 is provided so as to face the photosensitive drums 32 of the image forming units 200K, 200C, 200M and 200Y. The image transfer portion 5 is configured to transfer the toner image from the photosensitive drums 32 to the printing medium 1. As shown in FIG. 1, the image transfer portion 5 includes a transfer belt 51, a belt driving roller 52, a driven roller 53 and transfer rollers 54K, 54C, 54M and 54Y. The transfer rollers 54K, 54C, 54M and 54Y are provided so as to face the respective photosensitive drums 32 of the image forming units 200K 200C, 200M and 200Y via the transfer belt 51.

The transfer belt 51 is an endless belt, and is stretched around the belt driving roller 52 and the driven roller 53 as shown in FIG. 1. The transfer belt 51 is moved (rotated) by the rotation of the belt driving roller 52 in such a manner that an upper part of an outer circumferential surface of the transfer belt 51 contacts the surfaces of the photosensitive drums 32, while the transfer belt 51 conveys the printing medium 1 through the image forming units 200K, 200C, 200M and 200Y.

The image forming units 200K, 200C, 200M and 200Y and the image transfer portion 5 are driven in synchronization with each other by the control unit 101. The printing medium 1 held by the transfer belt 51 (by means of electrical absorption) is conveyed by the transfer belt 51 and reaches a nip portion between the photosensitive drum 32 and the transfer roller 54K. The transfer roller 54 is applied with a transfer voltage by the control unit 101, and the black toner image is transferred from the photosensitive drum 32 to the surface of the printing medium 1. The printing medium 1 with the black toner image is conveyed through the image forming units 200C, 200M and 200Y and the transfer rollers 54C, 54M and 54Y, so that the toner images of cyan, magenta and yellow are transferred to the printing medium 1. The printing medium 1 with the toner images of the respective colors is conveyed by the transfer belt 51 to an image fixing portion 6.

The image fixing portion 6 is configured to fix the toner image (transferred to the printing medium 1) to the printing medium 1. The image fixing portion 6 includes a fixing roller 61, a fixing belt 62, a heating roller 63 and a pressure roller 64. The fixing belt 62 is an endless belt, and is stretched around the fixing roller 61 and the heating roller 63. A heater (as a heat source) is provided in the heating roller 63 for heating the heating roller 63. The pressure roller 64 is pressed against the fixing roller 61 via the heating roller 63. The fixing roller 61, the heating roller 63 and the pressure roller 64 rotate in synchronization with each other under the control of the control unit 101. The printing medium 1 passes between the fixing belt 62 and the pressure roller 64, and the toner image is heated and pressed. The printing medium 1 with the fixed toner image is conveyed to an ejection portion 7.

An ejection sensor S3 is provided on a downstream side of the image fixing portion 6. The ejection sensor S3 detects a leading edge of the printing medium 1, and outputs a detection signal to the control unit 101. Based on the detection signal, the control unit detects that the printing medium 1 is conveyed to the ejection portion 7.

The ejection portion 7 includes a pair of ejection rollers 71, another pair of ejection rollers 72 and an ejection opening 73. The ejection portion 7 is configured to eject the printing medium 1 to a stacker 8 outside the image forming apparatus 100. The printing medium 1 is conveyed by the ejection rollers 71 and 72, ejected through the ejection opening 73, and is placed on the stacker 8.

In FIG. 2, the residual toner that remains on the surface of the photosensitive drum 32 of the image forming unit 200K (after the transferring of the toner image) is scraped off by the clearing blade 33. The scraped-off toner is conveyed by a waste toner conveying member 34 to a waste toner chamber provided outside the image forming unit 200K. Similarly, the residual toners on the surfaces of the photosensitive drum 32 of the image forming units 200C, 200M and 200Y are scraped off by cleaning blades 33. The scraped-off toners are conveyed by waste toner conveying members 34 to respective waste toner chambers provided outside the image forming units 200C, 200M and 200Y.

Figure 3:
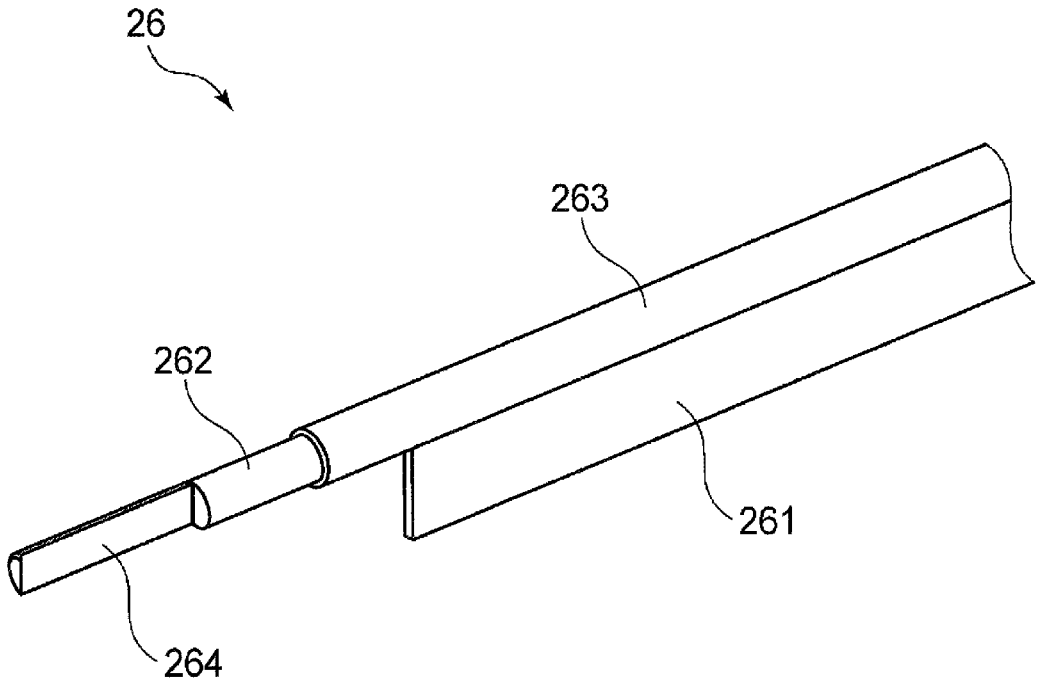
FIG. 3 is a perspective view showing an agitating portion according to the first embodiment of the present invention.
Figure 4:
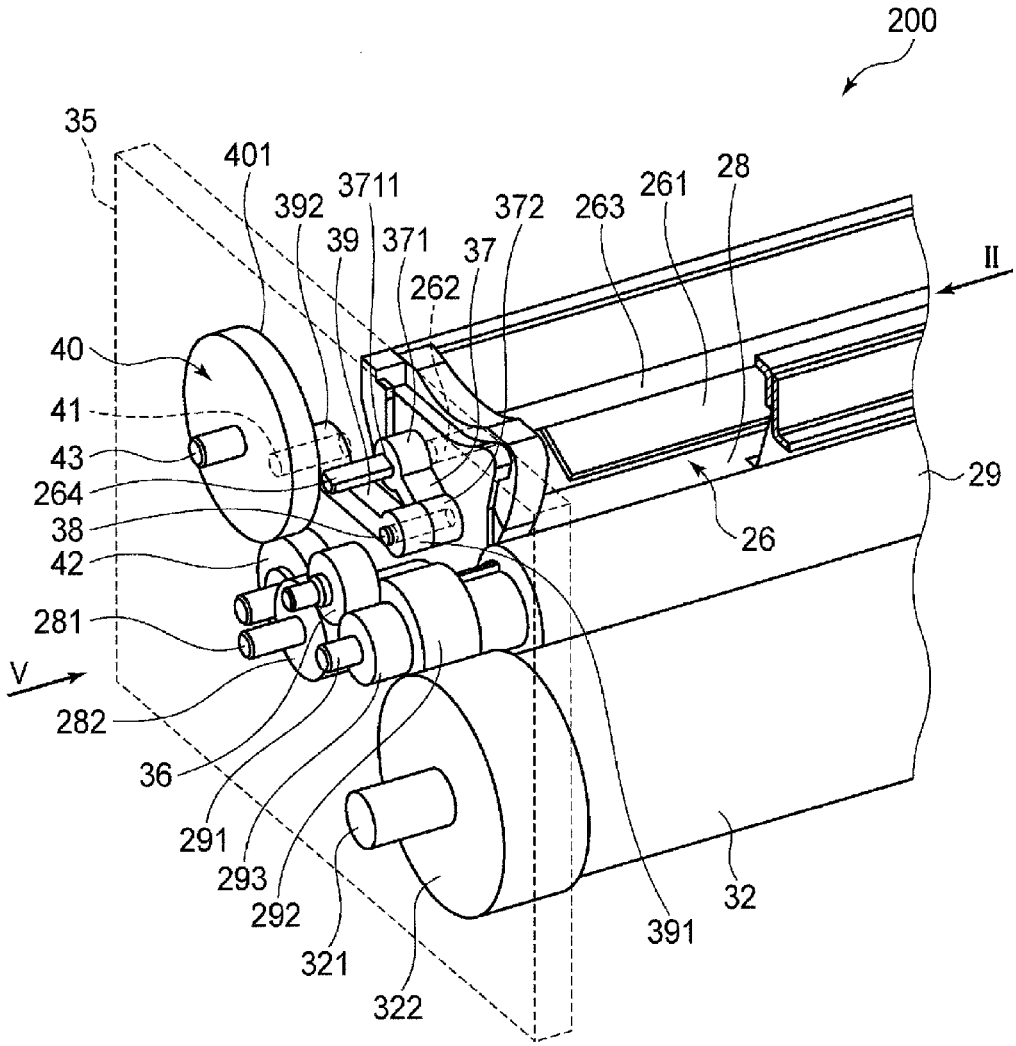
FIG. 4 is a perspective view showing a link mechanism of the agitating portion according to the first embodiment of the present invention.

Next, a configuration of the agitating portion 26 of the first embodiment will be described. FIG. 3 is a perspective view showing the agitating portion 26. FIG. 4 is a perspective view showing a link mechanism for swinging the agitating portion 26. The agitating portion 26 is provided in the toner hopper 25. As shown in FIG. 3, the agitating portion 26 includes an agitating plate 261 (as a plate member) in the form of an elongated plate, and a cylindrical portion 263 formed at a widthwise end (i.e., a longer edge) of the agitating plate 261 and extending along the longitudinal direction of the agitating plate 261. The agitating portion 26 further includes a rotation shaft 262 inserted into the cylindrical portion 263. The rotation shaft 262 and the cylindrical portion 263 are configured to rotate together with each other. A grip portion 264 is formed on an end of the rotation shaft 262. The grip portion 264 has a substantially semicircular cross section and has a predetermined length in a longitudinal direction of the rotation shaft 262.

As shown in FIG. 4, the grip portion 264 of the agitating portion 26 is inserted into an engaging hole 3711 of a semicircular shape formed on a first end 371 of a first lever 37. The first lever 37 is a part of a lever assembly that forms the link mechanism (i.e., a driving mechanism). With such a structure, the rotation shaft 262 of the agitating portion 26 is coupled with the first lever 37 so that the rotation shaft 262 is not rotatable relative to the first lever 37.

A second end (i.e., the other end) 372 of the first lever 37 rotatably engages a lever post 38. The lever post 38 engages a first end 391 of a second lever 39 which is a part of the lever assembly. A second end (i.e., the other end) 392 of the second lever 39 rotatably engages a crank post 41 projected from a side surface 401 of a crank gear 40. The first and second levers 37 and 39 and the lever post 38 constitute the lever assembly.

The crank gear 40 as a rotation member (or a driving gear) is mounted to the rotation shaft 43 supported by a side frame 35 as shown in FIG. 4. The crank gear 40 engages a gear 282 via an idle gear 42. The gear 282 is fixed to a shaft 281 of the supplying roller 28. The crank gear 40 starts rotation as the supplying roller 28 starts rotation. The crank post 41 is formed on the side surface 401 of the crank gear 40 so that a center of the crank post 41 is located at a distance L1 (FIG. 5A) from a center of the rotation shaft 43. When the crank gear 40 rotates about the rotation shaft 43, the crank post 41 moves along a circular trajectory having a center on the rotation shaft 43 and having a radius of L1 (FIGS. 5A through 8B). In this regard, the rotation shaft 262 of the agitating portion 26 penetrates both side frames 35 and is rotatably supported at the side frames 35. The crank gear 40, the second lever 39, the first lever 37 and the grip portion 264 constitute the link mechanism (i.e., the lever assembly, or the driving mechanism).

Both ends of the shaft 321 of the photosensitive drum 32 are rotatably supported at the side frames 35 (only one side frame 35 is shown in FIG. 4). An end of the shaft 321 penetrates the side frame 35 to outside, and a gear 322 is fixed to the end of the shaft 321. A rotation of a drum driving motor (not shown) is transmitted to the gear 322, and the photosensitive drum 32 rotates.

Further, both ends of the shaft 291 of the developing roller 29 are rotatably supported at the side frames 35. A large gear 292 and a small gear 293 are fixed to the end of the shaft 291 outside the frame 35. The large gear 292 engages the gear 322 of the photosensitive drum 32. Therefore, the developing roller 29 rotates together with the photosensitive drum 32. The small gear 293 engages an idle gear 36.

The idle gear 36 engages the gear 282 fixed to an end of the shaft 281. The gear 282 of the supplying roller 28 engages the idle gear 42 for rotating the crank gear 40. Therefore, when the photosensitive drum 32 rotates, the developing roller 29, the supplying roller 28 and the crank gear 40 rotate.

<Operation>

Figure 5A:
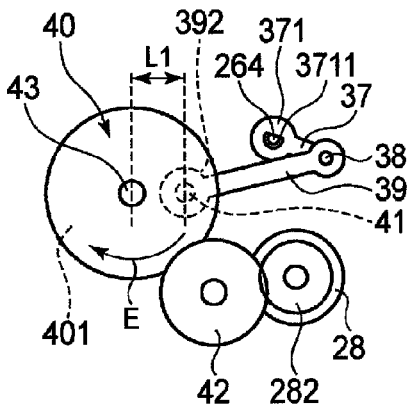
FIGS. 5A and 5B are schematic views showing an operation of the agitating portion according to the first embodiment of the present invention.
Figure 5B:
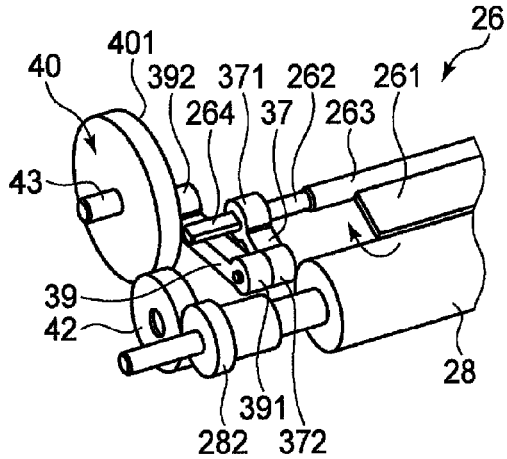
Figure 6A:
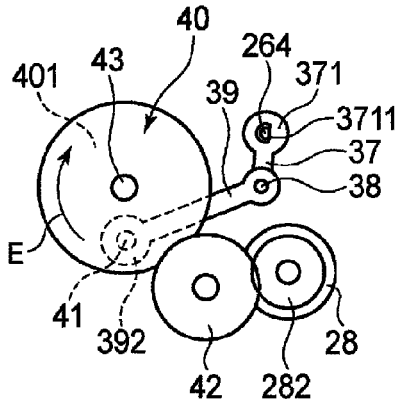
FIGS. 6A and 6B are schematic views showing the operation of the agitating portion according to the first embodiment of the present invention.
Figure 6B:
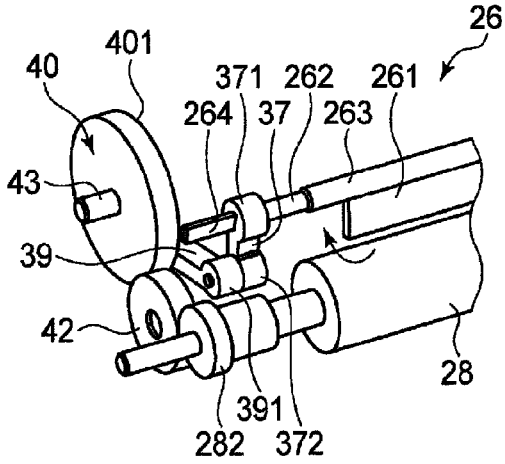
Figure 7A:
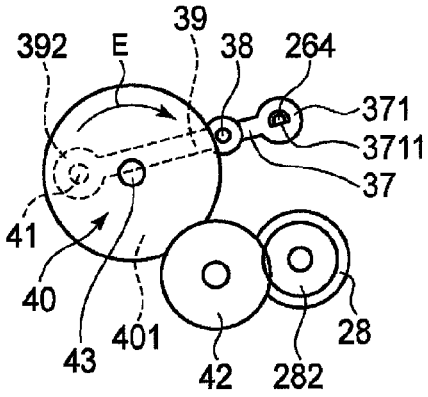
FIGS. 7A and 7B are schematic views showing the operation of the agitating portion according to the first embodiment of the present invention.
Figure 7B:
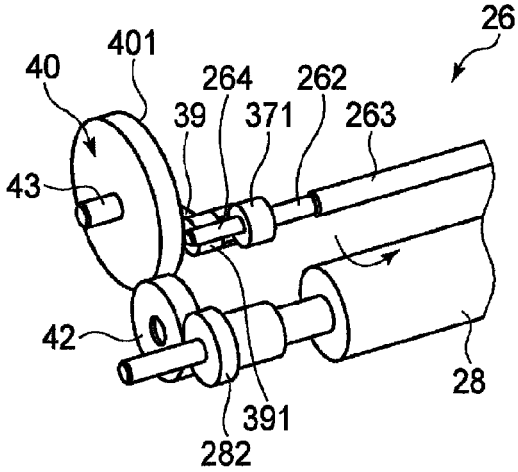
Figure 8A:
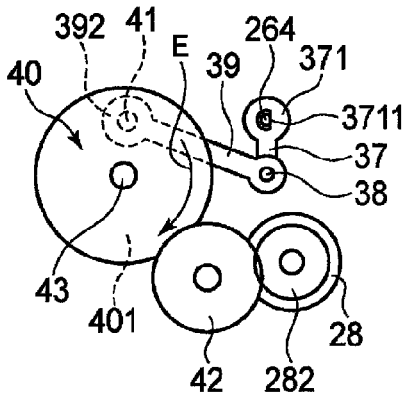
FIGS. 8A and 8B are schematic views showing the operation of the agitating portion according to the first embodiment of the present invention.
Figure 8B:
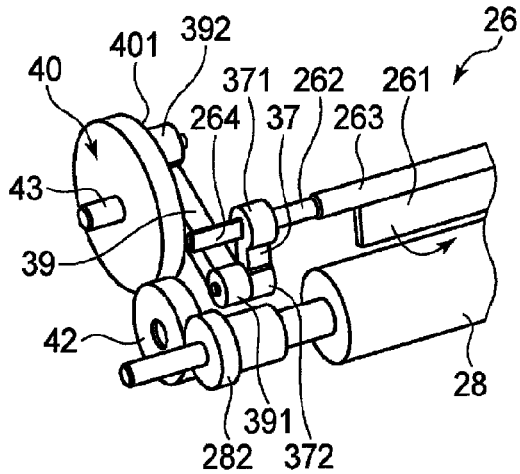

An operation of the agitating portion 26 according to the first embodiment will be described with reference FIGS. 5A through 8B. FIGS. 5A and 5B show a first step of an operation of the agitating portion 26. FIGS. 6A and 6B show a second step of the operation of the agitating portion 26. FIGS. 7A and 7B show a third step of the operation of the agitating portion 26. FIGS. 8A and 8B show a fourth step of the operation of the agitating portion 26. In this regard, FIGS. 5A, 6A, 7A and 8A are schematic side views as seen in a direction shown by an arrow V in FIG. 4, while FIG. 2 is a side view as seen in the opposite direction shown by an arrow II in FIG. 4. FIGS. 5B, 6B, 7B and 8B are schematic perspective view.

In the image forming unit 200, the control unit 101 supplies a power to the drum driving motor, and the photosensitive drum 32 (FIG. 4) starts rotating. When the photosensitive drum 32 rotates, the large gear 292 of the developing roller 29 engaging the gear 322 of the photosensitive drum 32 rotates as shown in FIG. 4.

When the large gear 292 rotates, the developing roller 29 rotates, and therefore the smaller gear 293 rotates. When the small gear 293 rotates, the idle gear engaging the small gear 293 rotates. When the idle gear 36 rotates, the gear 282 of the supplying roller 28 engaging the idle gear 36 rotates. When the gear 282 rotates, the idle gear 42 engaging the gear 282 rotates.

When the idle gear 42 rotates, the crank gear 40 engaging the gear 282 rotates about the rotation shaft 43. When the crank gear 40 rotates, the crank post 41 moves along a circular trajectory having a radius L1 from a center on the rotation shaft 43.

When the crank gear 40 starts rotation, the agitating plate 261 is located in a lower right position as shown in FIGS. 5A and 5B. That is, an end (i.e., a free end) of the agitating plate 261 is located on the point A shown in FIG. 2. In this state (FIGS. 5A and 5B), a crank angle (i.e., a rotation angle) of the crank gear is defined as 0 degree. The crank gear 40 starts rotating in a direction shown by an arrow E (clockwise in FIG. 5A) according to the rotation of the idle gear 42.

When the crank gear 40 rotates clockwise, the second lever 39 (engaging the crank post 41) moves from a right position toward a lower position as shown in FIGS. 5A and 5B. When the second lever 39 moves from the right position toward the lower position, the second end 372 of the first lever 37 (engaging the lever post 38) also moves from a right position toward a lower position. In this state, the first end 371 of the first lever 37 rotates clockwise about the semicircular engaging hole 3711 formed on the first end 371. Therefore, the grip portion 264 of the agitating portion 26 (engaging the engaging hole 3711) rotates clockwise, with the result that the agitating plate 261 of the agitating portion 26 swings in an arc about the cylindrical body 263 from the point A toward a point B (FIG. 2).

When the crank gear 40 rotates clockwise (as shown by the arrow E) by 90 degrees from the start of rotation (FIGS. 5A and 5B), the agitating plate 261 reaches the point B (FIG. 2) as shown in FIGS. 6A and 6B.

When the crank bar 40 further rotates clockwise (as shown by the arrow E), the second lever 39 engaging the crank post 41 moves from the lower position toward an upper left position as shown in FIGS. 7A and 7B. When the second lever 39 moves toward the upper left position, the second end 372 of the first lever 37 (engaging the lever post 38) also moves from the lower position toward the upper left position. In this state, the first end 371 of the first lever 37 rotates about the semicircular engaging hole 3711 formed on the first end 371. Therefore, the grip portion 264 of the agitating portion 26 (engaging the engaging hole 3711) rotates clockwise, with the result that the agitating plate 261 further swings in an arc about the cylindrical body 263 from the point B toward the point C (FIG. 2).

When the crank gear 40 rotates clockwise (as shown by the arrow E) by 180 degrees from the start of rotation, the agitating plate 261 reaches the point C (FIG. 2).

When the crank gear 40 further rotates clockwise (as shown by the arrow E), the second end 392 of the second lever 39 moves upward, and the first end 391 of the second lever 39 moves downward as shown in FIGS. 8A and 8B. With such a movement of the second lever 39, the second end 372 of the first lever 37 engaging the lever post 38 moves downward (rotates counterclockwise). The first end 371 of the first lever 37 rotates counterclockwise about the semicircular engaging hole 3711 formed on the first end 371. Therefore, the agitating plate 261 swings counterclockwise in an arc about the cylindrical body 263 from the point C toward a point D (FIG. 2).

When the crank gear 40 rotates clockwise (as shown by the arrow E) by 270 degrees from the start of rotation, the agitating plate 261 reaches the point D (FIG. 2).

When the crank gear 40 further rotates clockwise, the second end 392 of the second lever 39 moves downward, and the first end 391 of the second lever 39 moves upward. With such a movement of the second lever 39, the second end 372 of the first lever 37 engaging the lever post 38 rotates counterclockwise. Therefore, the agitating plate 261 swings counterclockwise in an arc from the point D toward the point A (FIG. 2). When the crank gear 40 rotates clockwise (as shown by the arrow E) by 360 from the start of rotation, the agitating plate 261 reaches the point A (FIG. 2). As the agitating plate 261 repeatedly and reciprocatingly swings in an arc, the agitating plate 261 agitates the toner 21 in the vicinity of the supplying roller 28 in the toner hopper 25.

Figure 9:
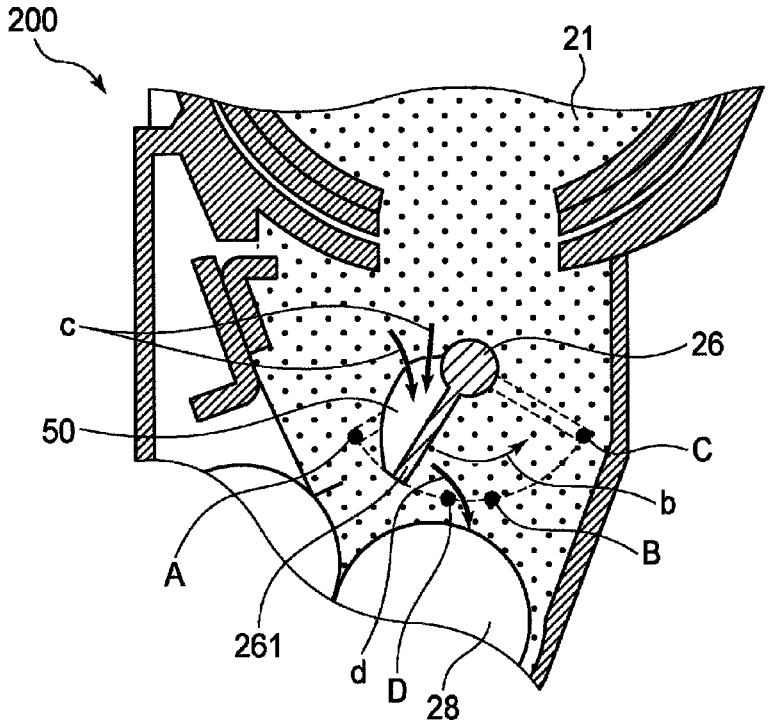
FIG. 9 is a schematic view showing a movement of a toner in the vicinity of a point A of the agitating portion according to the first embodiment of the present invention.
Figure 10:
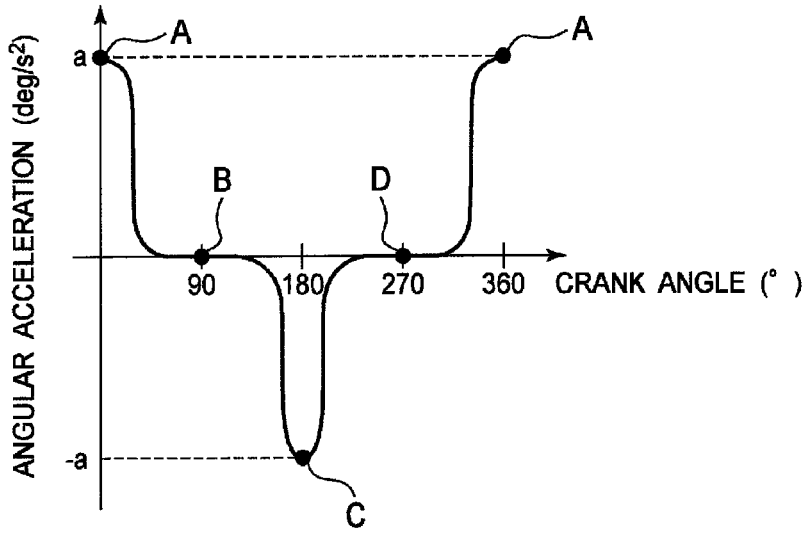
FIG. 10 is a graph showing a relationship between an angular acceleration of the agitating portion and a rotation speed of a crank gear according to the first embodiment of the present invention.

FIG. 9 is a schematic view showing a movement of the toner 21 in the vicinity of the point A of the agitating portion 26. FIG. 10 is a graph showing a relationship between an angular acceleration of the agitating portion 26 and a rotational position (i.e., a crank angle) of the crank gear 40. A movement of the toner caused by the angular acceleration of the agitating portion 26 will be described with reference to FIGS. 9 and 10. Here, the points A and B (FIG. 9) are uppermost positions of an arc-shaped trajectory of the agitating plate 261 during the swinging of the agitating portion 26.

As shown in FIG. 10, the angular acceleration of the agitating plate 261 increases when the agitating plate 261 starts swinging in an arc in a direction shown by an arrow "b" from the point A toward the point B as shown in FIG. 9. Therefore, when the agitating plate 261 starts swinging in the direction shown by the arrow "b", a space 50 where no toner exists is instantly formed on the downstream side of (behind) the agitating plate 261 as shown in FIG. 9.

In FIG. 10, a vertical axis indicates an angular acceleration of the agitating portion 26, and a horizontal axis indicates a rotational position (i.e., a crank angle) of the agitating portion 26. Further, "a" (deg/$s^2$) indicates an angular acceleration at a starting position (where the agitating plate 261 start swinging), and "−a" (deg/$s^2$) indicates an angular acceleration at a reverse position (where the agitating plate 261 reverses the swinging direction).

A negative pressure is generated in the space 50 where no toner exists, and therefore the toner 21 flows into the space 50 in the direction shown by an arrow "c" in FIG. 9. The toner 21 accumulated above the agitating portion 26 breaks apart, and flows into the space 50, so that the toner 21 in the toner hopper 25 is largely agitated. In this state, the toner 21 existing on the upstream side of the agitating plate 261 moves in a direction shown by an arrow "d", and is supplied to the supplying roller 28. The same can be said when the agitating plate 261 starts swinging in an arc from the point C toward the point D (FIG. 9). Therefore, it becomes possible agitate the toner 21 outside an area (including the points A, D, B and C) in which the agitating plate 261 swings. In this regard, the points B and D (FIG. 9) are positions where the angular acceleration of the agitating plate 261 becomes 0 (zero) as shown in FIG. 10.

As shown in FIG. 9, the agitating plate 261 of the agitating portion 26 swings in an arc in such a manner that the agitating plate 261 reaches the vicinity of the surface of the supplying roller 28 but does not contact the supplying roller 28. The closest distance between the end of the agitating plate 261 of the agitating portion 26 and the surface of the supplying roller 28 is in a range from 0.5 mm to 5.0 mm.

<Advantages>

As described above, the agitating portion 26 of the first embodiment is configured so that the end of the agitating plate 261 reciprocatingly swings in arc between the point A and the point C as shown in FIG. 2, and therefore an area in which the toner 21 is agitated increases. Thus, it becomes possible to agitate the toner 21 in a large area in the vicinity of the supplying roller 28 in the toner hopper 25, without requiring a plurality of agitating member.

Further, since the end of the agitating plate 261 reciprocatingly swings in an arc, the space 50 where no toner exists is formed on the downstream side of the agitating plate. 261 when the end of the agitating plate 261 moves downward from the uppermost position (the point A or C) toward the lower position (the point B or D). Therefore, the toner 21 accumulated above the agitating plate 261 flows into the space 50, and it becomes possible to agitate the toner 21 even outside the area in which the agitating plate 261 swings. Accordingly, the agitating portion 26 can be swung by a small load, and an area in which the toner is not agitated can be remarkably reduced.

Thus, by provision of one agitating portion 26, the toner 21 in the vicinity of the supplying roller 28 can be agitated, and the agglomeration of the toner 21 can be prevented, so that a stable amount of the toner 21 can be supplied to the supplying roller 28. As a result, occurrence of image defects such as image blurring can be reduced.

Moreover, the image forming unit 200 has only one agitating portion 26, and therefore a manufacturing cost can be reduced, as compared with a prior art having a plurality of agitating portions.

Second Embodiment

<Configuration>

In a general image forming unit of a general image forming apparatus, agglomeration of a toner is likely to occur in a toner hopper under a high temperature and high humidity environment. In such a case, an amount of the toner supplied to a supplying roller may decrease, and image defects such as image blurring may occur.

The image forming unit 200*a* according to the second embodiment of the present invention is intended to prevent occurrence of image defects under the high temperature and high humidity environment. For this purpose, the image forming unit 200*a* of the second embodiment has the following components in addition to the components of the image forming unit 200 of the first embodiment. That is, an agitating portion 26*a* of the image forming unit 200*a* has a thin film member 265 (as a first resilient body) that contacts the surface of the supplying roller 28, and a fixing member 266 for fixing the thin film member 265 to the agitating plate 261. The thin film member 265 contacts the surface of the supplying roller 28, so that the toner 21 is directly supplied to the supplying roller 28. The image forming apparatus of the second embodiment except the image forming unit 200*a* is the same as the image forming apparatus 100 of the first embodiment except the image forming unit 200.

Figure 11:
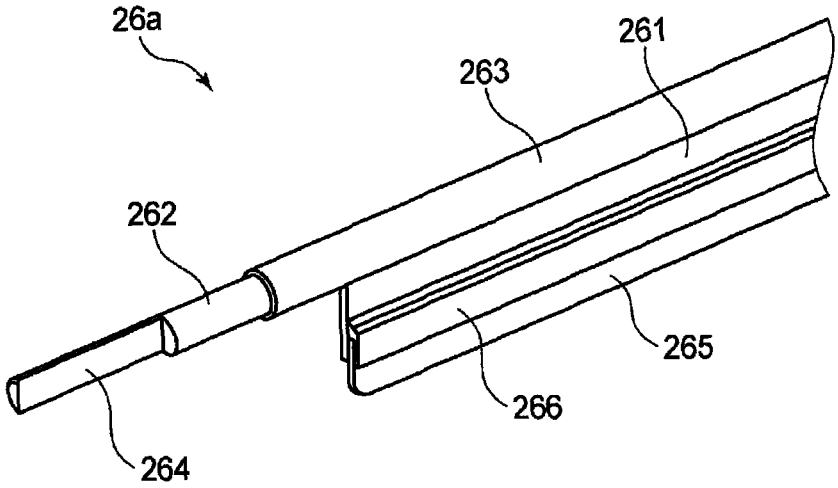
FIG. 11 is a perspective view showing an agitating portion according to the second embodiment of the present invention.

FIG. 11 is a perspective view showing the agitating portion 26*a* of the second embodiment. As shown in FIG. 11, the agitating portion 26*a* includes the thin film member 265 fixed to the agitating plate 261. The thin film member 265 is elongated in the longitudinal direction of the agitating plate 261 (axial direction of the agitating portion 26*a*), and an end (i.e., a widthwise end) of the thin film member 265 is fixed to an end (as a first end) of the agitating plate 261. More specifically, the thin film member 265 is fixed to a surface of the agitating plate 261 using the fixing member 266 having an elongated shape.

The thin film member 265 is composed of a resilient body such as PET (polyethylene terephthalate) film, PP (polypropylene) film or the like, and has a thickness in a range from 0.1 mm to 0.2 mm. A part of the thin film member 265 is sandwiched between the fixing member 266 and the agitating plate 261, and is bonded to the fixing member 266 and the agitating plate 261 by means of bonding agent or thermal welding. An end (i.e., a free end) of the thin film member 265 is deformed by an amount in a range from 1 mm to 5 mm when contacting the surface of the supplying roller 28. The amount of deformation of the thin film member 265 is adjusted by, for example, a width of the thin film member 265 during a process in which the thin film member 265 is fixed to the agitating plate 261.

In other respects, the agitating portion 26*a* of the second embodiment is the same as the agitating portion 26 of the first embodiment. Further, the image forming unit 200*a* except the agitating portion 26*a* of the second embodiment is the same as the image forming unit 200 of the first embodiment except the agitating portion 26.

<Operation>

Figure 12:
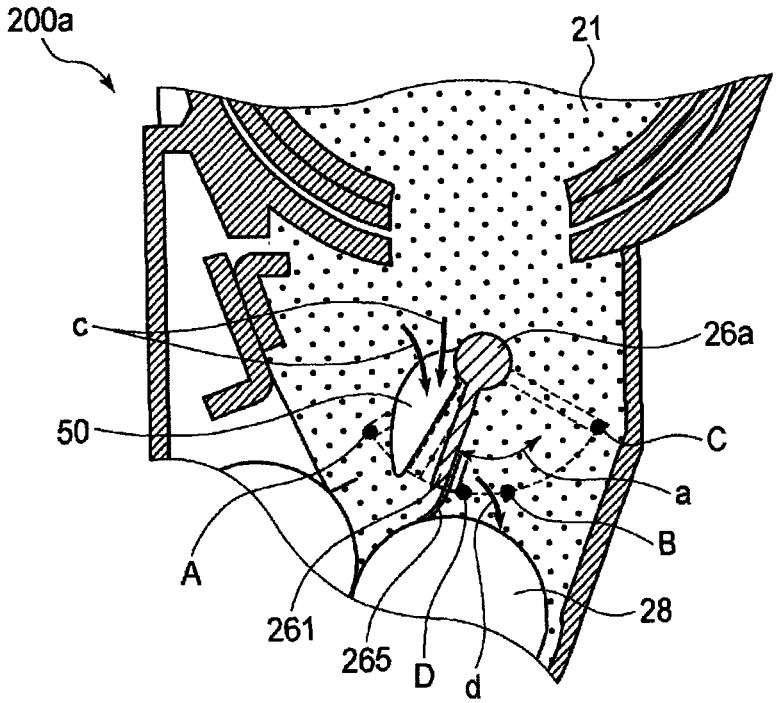
FIG. 12 is a sectional view showing an agitating portion according to the second embodiment of the present invention.

FIG. 12 is a schematic view showing an operation of the agitating portion 26*a* according to the second embodiment. The operation of the agitating portion 26*a* of the image forming unit 200*a* and the movement of the toner 21 caused by the agitating portion 26*a* will be described with reference to FIG. 12. In the image forming unit 200*a* of the second embodiment, the operation of the agitating portion 26*a* before starting rotation is the same as that of the agitating portion 26 of the image forming unit 200 of the first embodiment.

The angular acceleration of the agitating portion 26*a* increases when the agitating plate 261 starts swinging in an arc from the point A toward the point B as shown in FIG. 12, as is the case with the agitating portion 26 of the first embodiment. Therefore, when the agitating portion 26*a* starts swinging, the space 50 in which no toner exists is instantly formed on the downstream side of (behind) the agitating plate 261 as shown in FIG. 12. A negative pressure is generated in the space 50, and the toner 21 flows into the space 50 in the direction shown by the arrow "c". Therefore, the toner 21 accumulated above the agitating portion 26*a* breaks apart, and flows into the space 50. Thus, the toner 21 is the toner hopper 25 is largely agitated. In this state, the toner 21 existing on the upstream side of the agitating plate 261 of the agitating portion 26*a* moves in a direction shown by the arrow "d".

When the toner 21 moves in the direction shown by the arrow "d", the thin film member 265 of the agitating portion 26*a* contacts the surface of the supplying roller 28 while being bent, and supplies the toner 21 to the surface of the supplying roller 28. The same can be said when the agitating plate 261 starts swinging in an arc from the point C toward the point D (FIG. 12).

<Advantages>

The agitating portion 26*a* of the second embodiment has the thin film member 265 contacting the surface of the supplying roller 28 for directly supplying the toner 21 to the surface of the supplying roller 28. Therefore, in addition to the advantages of the first embodiment, a more stable amount of the toner 21 can be supplied to the surface of the supplying roller 28.

Accordingly, the image forming apparatus including the image forming unit 200*a* having the agitating portion 26*a* according to the second embodiment is capable of further reducing occurrence of image defects such as image blurring, as compared With the image forming apparatus 100 of the first embodiment. Particularly, occurrence of image defects can be reduced even under the high temperature and high humidity environments.

Third Embodiment

<Configuration>

In a general image forming unit of a general image forming apparatus, a supplying opening is formed to connect a toner storage container (i.e., a toner cartridge) and a toner hopper. The supplying opening is generally made small, in order to prevent a hand of a user from being made dirty during an attachment or detachment operation of the toner storage container. Since the supplying opening is small, the toner is likely to be agglomerated in the supplying opening, and therefore an amount of the toner supplied to the supplying roller decreases. In such a case, image defects such as image blurring may occur.

An image forming unit 200*b* of an image forming apparatus according to the third embodiment is intended to prevent agglomeration of the toner in the small supplying opening. For this purpose, the image forming unit 200*b* of the third embodiment has the following components in addition to the components of the image forming unit 200 of the first embodiment. That is, an agitating portion 26*b* of the image forming unit 200*b* includes a first thin film member 265 (which is the same as the thin film member 265 of the second embodiment) that contacts the surface of the supplying roller 28, a second thin film member 267 (as a second resilient body) that contacts the supplying opening 24, and a fixing member 268 for fixing the first and second thin film members 265 and 267 to the agitating plate 261. The second thin film member 267 contacts an inner surface (i.e., a side wall) of the supplying opening 24, so as to prevent the agglomeration of the toner 21 in the supplying opening 24. The image forming apparatus of the third embodiment except the image forming unit 200*b* is the same as the image forming apparatus 100 of the first embodiment except the image forming unit 200.

Figure 13:
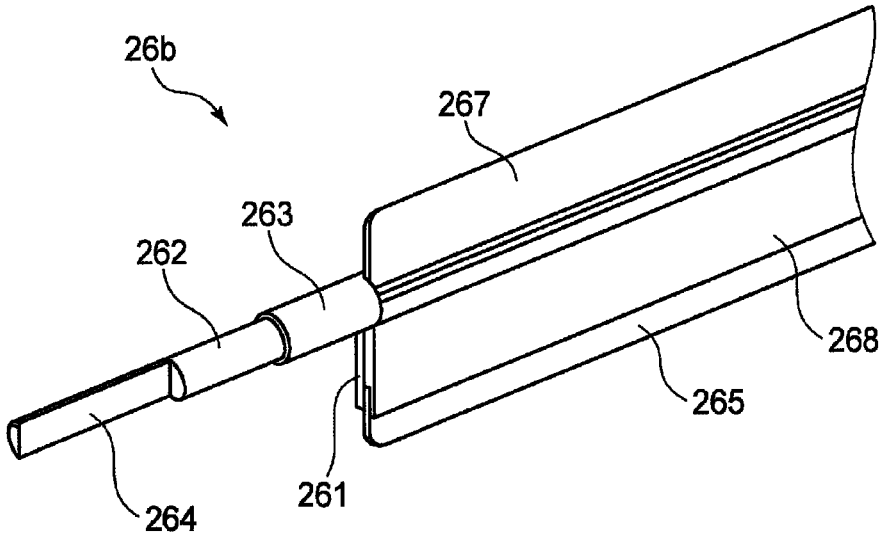
FIG. 13 is a perspective view showing an agitating portion according to the third embodiment of the present invention.

FIG. 13 is a perspective view showing the agitating portion 26*b* of the third embodiment. As shown in FIG. 13, the agitating portion 26*b* includes the first thin film member 265 and the second thin film member 267 fixed to the agitating plate 261. The first thin film member 265 and the second thin film member 267 are both elongated in the longitudinal direction of the agitating plate 261. An end (a widthwise end) of the first thin film member 265 is fixed to an end (as a first end) of the agitating plate 261. Further, an end of the second thin film member 267 is fixed to the other end (as a second end) of the agitating plate 261. The first thin film member 265 and the second thin film member 267 are fixed to a surface of the agitating plate 261 using the fixing member 268 having an elongated shape.

The first and second thin film members 265 and 267 are composed of a resilient body such as PET (polyethylene terephthalate) film, PP (polypropylene) film or the like, and have a thickness in a range from 0.1 mm to 0.2 mm. Parts of the first and second thin film members 265 and 267 (sandwiched between the fixing member 268 and the agitating plate 261) are bonded to the fixing member 268 and the agitating plate 261 by means of bonding agent or thermal welding. An end (i.e., a free end) of the first thin film member 265 is deformed by an amount in a range from 1 mm to 5 mm when contacting the surface of the supplying roller 28. The amount of deformation of the thin film member 265 is adjusted by, for example, a width of the first thin film member 265 during a process in which the thin film member 265 is fixed to the agitating plate 261. In other respects, the agitating portion 26*b* of the third embodiment is the same as the agitating portion 26 of the first embodiment. Further, the image forming unit 200*b* except the agitating portion 26*b* of the third embodiment is the same as the image forming unit 200 of the first embodiment except the agitating portion 26.

<Operation>

Figure 14:
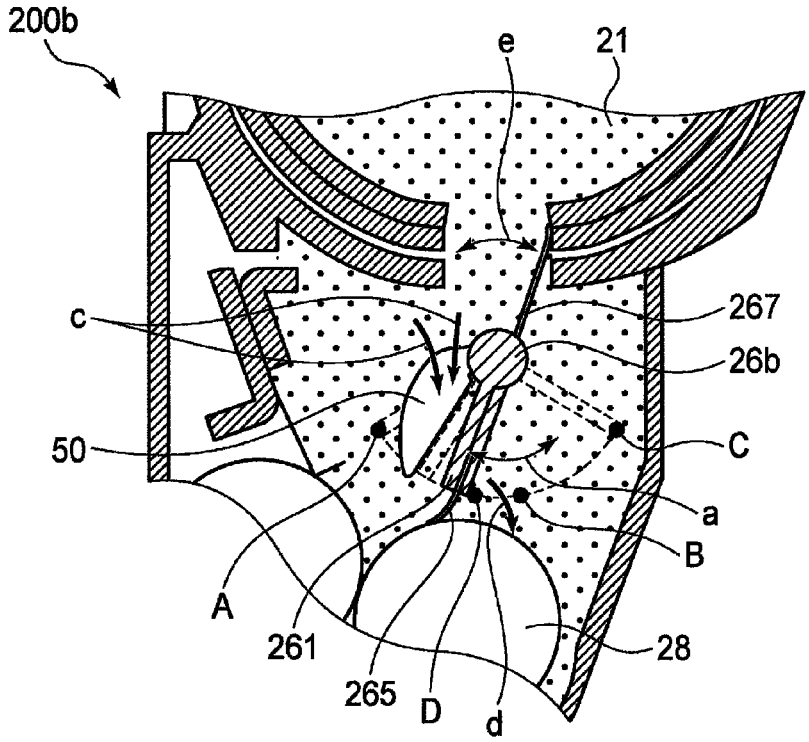
FIG. 14 is a sectional view showing an agitating portion according to the third embodiment of the present invention.

FIG. 14 is a schematic view showing an operation of the agitating portion 26*b* according to the third embodiment.

The operation of the agitating portion 26*b* of the image forming unit 200*b* and the movement of the toner 21 caused by the agitating portion 26*b* will be described with reference to FIG. 14.

In the image forming unit 200*b* of the third embodiment, the operation of the agitating portion 26*b* before starting rotation is the same as that of the agitating portion 26 of the image forming unit 200 of the first embodiment.

When the agitating portion 26*b* starts reciprocating swinging, the second thin film member 267 starts swinging in the supplying opening 24 in a direction as shown by an arrow "e" (i.e., left-right direction in FIG. 14). If the toner 21 adheres to an inner surface (i.e., a side wall) of the supplying opening 24, the toner 21 is scraped off from the inner surface of the supplying opening 24 by the second thin film member 267 that swings in the direction as shown by the arrow "e". The scraped-off toner 21 is smoothly (by itself) supplied to the toner hopper 25.

The angular acceleration of the agitating portion 26*b* increases when the agitating plate 261 starts swinging in an arc from the point A toward the point B as shown in FIG. 14, as is the case with the agitating portion 26 of the first embodiment. Therefore, when the agitating portion 26*b* starts swinging, the space 50 in which no toner exists is instantly formed on the downstream side of the agitating plate 261 as shown in FIG. 14.

A negative pressure is generated in the space 50, and the toner 21 flows into the space 50 in the direction shown by the arrow "c". Therefore, the toner 21 accumulated above the agitating portion 26*b* breaks apart, and flows into the space 50. Thus, the toner 21 stored in the toner hopper 25 is largely agitated. In this state, the toner 21 existing on the upstream side of the agitating plate 261 of the agitating portion 26*b* moves in the direction shown by the arrow "d".

When the toner 21 moves in the direction shown by the arrow "d", the first thin film member 265 of the agitating portion 26*b* contacts the surface of the supplying roller 28 while being bent, and supplies the toner 21 to the surface of the supplying roller 28. The same can be said when the agitating plate 261 starts swinging in an arc from the point C toward the point D (FIG. 14).

<Advantages>

The agitating portion 26*b* of the third embodiment has the second thin film member 267 contacting the inner surface of the supplying opening 24, and is capable of scraping off the toner 21 from the inner surface of the supplying opening 24 before the toner 21 is highly agglomerated.

In a general image forming unit having a small supplying opening, a toner adhering to an inner surface of the supplying opening falls therefrom when the toner is highly agglomerated. Therefore, the amount of the toner supplied to a supplying roller may be insufficient (when the toner adheres to the inner surface of the supplying opening), or may be excessively large (when the highly agglomerated toner falls from the inner surface of the supplying opening into the toner hopper). Thus, the amount of the toner supplied to the supplying roller is not stable.

In contrast, the agitating portion 26*b* according to the third embodiment has the second thin film member 267 as described above, and therefore a more stable amount of the toner 21 can be supplied to the surface of the supplying roller 28, as compared with the agitating portion 26 of the first embodiment and the agitating portion 26*a* of the second embodiment.

Accordingly, the image forming apparatus including the image forming unit 200*b* having the agitating portion 26*b* according to the third embodiment is capable of further reducing occurrence of image defects such as image blurring, as compared with the image forming apparatuses of the first and second embodiments. Particularly, occurrence of image defects can be reduced even when the small supplying opening is used.

In the third embodiment, the agitating portion 26*b* has both of the first thin film member 265 and the second thin film member 267. However, it is also possible that the agitating portion 26*b* has only the second thin film member 267.

In the above described embodiment, the color printer has been described as an example of an image forming apparatus using electrophotography. However, the present invention is also applicable to a monochrome printer, a copier, a facsimile, a multifunctional peripheral (MFP) or the like.

While the preferred embodiments of the present invention have been illustrated in detail, it should be apparent that modifications and improvements may be made to the invention without departing from the spirit and scope of the invention as described in the following claims.

What is claimed is:

1. An image forming unit comprising:

an image bearing body that bears a latent image;

a developer bearing body that develops said latent image;

a developer supplying portion that supplies said developer to said developer bearing body;

an agitating portion provided in the vicinity of said developer supplying portion, said agitating portion including a plate member for agitating said developer in the vicinity of said developer supplying portion and a rotation shaft that holds said plate member, and a driving mechanism that causes said plate member of said agitating portion to reciprocatingly swing in an arc about said rotation shaft.

2. The image forming unit according to claim 1, wherein said driving mechanism comprises:

a rotation member driven to rotate for rotating said rotation shaft, and a lever assembly linked with said rotation member and said rotation shaft, wherein said lever assembly causes said rotation shaft to reciprocatingly rotate by a predetermined angle corresponding to a rotation amount of said rotation member so as to cause said plate member of said agitating portion to reciprocatingly swing.

3. The image forming unit according to claim 2, wherein said rotation member is driven to rotate by a rotation of said developer supplying portion.

4. The image forming unit according to claim 3, wherein said rotation member is a driving gear that rotates in one direction, and said driving gear is connected with another gear for rotating said developer supplying portion.

5. The image forming unit according to claim 1, wherein, when said plate member reciprocatingly swings, a closest distance between an end of said plate member and a surface of said developer supplying portion is in a range from 0.5 mm to 5.0 mm.

6. The image forming unit according to claim 1, wherein a first resilient body is mounted to a first end of said plate member, wherein, when said plate member reciprocatingly swings, an end of said first resilient body contacts a surface of said developer supplying portion while being deformed.

7. The image forming unit according to claim 6, wherein an amount of deformation of said resilient body is in a range from 1 mm to 5 mm.

8. The image forming unit according to claim 1, further comprising a storage container storing said developer, and a supplying opening through which said developer is supplied from said storage container to said developer supplying portion, wherein said plate member is provided on a first side of said rotation shaft;

wherein a resilient member is provided on a second side of said rotation shaft and extends toward said supplying opening, said second side being opposite to said first side, and wherein, when said plate member reciprocatingly swings, said resilient member reciprocatingly swings so as to repeatedly contact a member that forms said supplying opening.

9. The image forming unit according to claim 1, further comprising a storage container storing said developer, and a supplying opening through which said developer is supplied from said storage container to said developer supplying portion, wherein a first resilient body is mounted to a first end of said plate member, and a second resilient body is mounted to a second end of said plate member, wherein, when said plate member reciprocatingly swings, an end of said first resilient body contacts a surface of said developer supplying portion while being deformed, and said second resilient body reciprocatingly swings so as to repeatedly contact said supplying opening.

10. An image forming apparatus comprising said image forming unit according to claim 1.

* * * * *